US009605362B2

(12) United States Patent
Cour

(10) Patent No.: US 9,605,362 B2
(45) Date of Patent: Mar. 28, 2017

(54) HYBRID ELASTIC CABLE AND PROCESS FOR MANUFACTURING SUCH A CABLE

(71) Applicant: CALYF, Maisons Laffitte (FR)

(72) Inventor: Francis Cour, Maisons-Lafitte (FR)

(73) Assignee: CALYF, Maisons Laffitte (FR)

( * ) Notice: Subject to any disclaimer, the term of this patent is extended or adjusted under 35 U.S.C. 154(b) by 0 days.

(21) Appl. No.: 14/374,489

(22) PCT Filed: Jan. 24, 2013

(86) PCT No.: PCT/EP2013/051381
§ 371 (c)(1),
(2) Date: Jul. 24, 2014

(87) PCT Pub. No.: WO2013/110731
PCT Pub. Date: Aug. 1, 2013

(65) Prior Publication Data

US 2014/0373502 A1 Dec. 25, 2014

(30) Foreign Application Priority Data

Jan. 24, 2012 (FR) ..... 12 50687

(51) Int. Cl.
*D02G 3/02* (2006.01)
*D02G 3/32* (2006.01)

(52) U.S. Cl.
CPC ..... *D02G 3/328* (2013.01); *D02G 3/32* (2013.01)

(58) Field of Classification Search
CPC D02G 3/26; D02G 3/28; D02G 3/328; D02G 3/38; D02G 3/32
(Continued)

(56) References Cited

U.S. PATENT DOCUMENTS 3,625,809 A 12/1971 Caroselli et al.
2009/0071196 A1* 3/2009 Karayianni ..... D02G 3/328 66/170

FOREIGN PATENT DOCUMENTS

EP 0111070 A1 6/1984
FR 1400692 A 5/1965
(Continued)

OTHER PUBLICATIONS

International Search Report dated Apr. 25, 2013 in PCT/EP2013/051381.
Written Opinion in PCT/EP2013/051381.

*Primary Examiner* — Nathan Durham
*Assistant Examiner* — Abby Spatz
(74) *Attorney, Agent, or Firm* — Knobbe Martens Olson & Bear LLP

(57) ABSTRACT

Hybrid elastic cable comprising at least one elastic filament yarn (1) and at least one resistant filament yarn (2), the elastic filament yarn (1), at a maximum rate of elongation of the cable, is found to be wound in a helix around the resistant filament yarn (2) with a specific number of turns per linear meter of the cable ($n_sE$) ranging between $n_{sE}$−15% and $n_{sE}$+15%, $n_{sE}$ being determined based on a specific formula, wherein the elastic filament yarn (1) moreover is also twisted about itself with a specific number of distinct turns about itself per linear meter of the cable ranging between $n_{sE}$ and $3\times n_{sE}$, and the distinct turns about itself of the elastic filament yarn (1) is wound in the opposite direction from that of the said helix.

16 Claims, 8 Drawing Sheets

(58) Field of Classification Search
USPC ..... 57/210, 235
See application file for complete search history.

(56) References Cited

FOREIGN PATENT DOCUMENTS

| | | | |
|---|---|---|---|
| WO | 2006/021763 | A1 | 3/2006 |
| WO | 2010/041002 | A1 | 4/2010 |
| WO | 2010/146347 | A1 | 12/2010 |

* cited by examiner

HYBRID ELASTIC CABLE AND PROCESS FOR MANUFACTURING SUCH A CABLE

CROSS-REFERENCE TO RELATED APPLICATIONS

This application is the U.S. National Phase under 35. U.S.C. §371 of International Application PCT/EP2013/051381, filed Jan. 24, 2013, which claims priority to French Patent Application No. 12 50687, filed Jan. 24, 2012. The disclosures of the above-described applications are hereby incorporated by reference in their entirety.

TECHNICAL FIELD

The present invention relates to the sector of textile filaments and yarns for technical uses and more particularly to an elastic cable intended to be used in the manufacture of textile products with high rated technical characteristics in terms of mechanical resistance and rate of elongation, such as cords, belting, straps or fabrics.

PRIOR ART

In a general sense, elastic cables are commonly produced by combining two filament yarns having different mechanical properties. Thus use is made of a first elastomeric filament yarn made of an elastomer such as natural rubber or spandex (elastane), for example, which has high elasticity, combined with a low elastic modulus and low resistance to wear and breaking. This first filament yarn is combined with one or more filament yarns that have high resistance to wear and breaking, combined with a high elastic modulus and a low elongation capacity, such as polyamide or polypropylene filament yarns, for example. On account of this combination, such cables shall be qualified in the remainder of the description as "hybrid cables".

These conventional hybrid cables are presented in the form of a central core constituted by the elastic filament yarn, whose tensile strength as a function of the rate of elongation is represented by the curve E shown as a solid line in the FIG. 1A. It should be recalled that the rate of elongation is calculated as the ratio of the elongation from a state of rest, divided by the resting length. This core is surrounded by a sheath formed by the resistant filament yarns, the tensile strength as a function of the rate of elongation of the resistant filament yarn being represented by the curve T shown as a dashed line in FIG. 1A. The fabrication of the sheath around the elastic core, is done using any one of the various conventional techniques, well known to the person skilled in the art such as: braiding, knitting, winding or wrapping.

With reference to the FIG. 1B which is a graph showing the tensile strength as a function of the rate of elongation, of a typical hybrid cable, the hybrid cables of the prior art first of all have a first zone (zone 1) of low load extending for example from 0% to 60% elongation in which the elongation increases rapidly as a function of the load. Then, from the level of 60%, there is a second zone (zone 2) wherein the stiffness of the cable increases progressively, until it breaks.

In the first zone (zone 1) of the diagram shown in FIG. 1B, the tensile strength of the cable is practically equal to that of the elastic filament yarn (and therefore analogous to that shown in solid lines in the FIG. 1A). The sheath supports the elongation of the elastic core by undergoing a modification of the geometrical shape of its meshes (in the case of knitted or braided sheaths) or its turns (in the case of a wound sheath). This modification consists of an elongation of the meshes or turns in the longitudinal direction and consecutively a shrinkage in the diametrical direction. This shrinkage in the diametrical direction causes a corresponding equivalent decrease in the inner diameter of the sheath; simultaneously, the diameter of the elastic core decreases due to the elongation that is imposed on the core. As long as the reduction in the diameter of the sheath does not exceed the reduction in the diameter of the elastic core, the reduction in the diameter of the sheath and in a correlated manner its extension in the longitudinal direction, may continue freely without causing significant tensioning of the resistant filament yarns of the sheath. This is the case throughout the first zone (zone 1) of the diagram shown in FIG. 1B. From a certain rate of elongation which is dependent upon the geometrical parameters of the resistant filament yarns, 60% in this example, the diameter of the sheath is reduced more rapidly than that of the elastic core which results in the compression of the elastic core encompassed in the sheath. This phenomenon is the cause of a progressive increase in the stiffness of the cable that appears at the beginning of the second zone (zone 2) of the diagram shown in the FIG. 1B; in addition, it generates a high level of stress at the interface between the elastic core and filament yarns of the sheath and between the filament yarns themselves. This phenomenon continues over the whole of the second zone (zone 2) of the diagram up to the point of breakage of the cable, set by way of example at approximately 150% of the rate of elongation.

The hybrid cables of the prior art thus present the disadvantage of having a relatively reduced zone of low load, on account of an increase in stiffness which occurs at relatively low degrees of elongation (several tens of percent below the elongation degree at the point of breakage). They also have an extremely progressive increase in the stiffness over the second zone, which is an unfavourable aspect with respect to ensuring a precise limitation of elongations.

Furthermore, these hybrid cables of the prior art have the disadvantage that they wear out quickly. Indeed, the resistant filament yarns are not parallel to the elastic core, and are thus subject to high stresses on account of the compression of the elastic filament yarns. These resistant filament yarns are subjected to a lot of friction thereby bringing about the premature wear thereof.

A description has been provided in the French patent application FR 2,910,047, of a woven belting which includes in the warp direction two types of parallel filament yarns, that is to say, on the one hand elastic filament yarns and on the other hand resistant filament yarns, made of textured organic filaments which, at rest, are in a crimped state. At low elongation, these crimped filaments progressively unfold without any resistance. The belting therefore behaves essentially as if it consisted only of elastic filament yarns. When the filaments reach their state of full elongation, their resistance to further elongation becomes manifest, which thereby conditions the behaviour of the belting. However, in this combination, it is difficult or even impossible to employ highly resistant filaments, because they generally cannot be texturised, and therefore cannot be crimped, on account of their stiffness.

Through the document WO2010/146347, a hybrid fibre comprising an elastic yarn, for example made of rubber, and a resistant yarn, having a high elastic modulus is also known. At rest, the resistant yarn is found to be wound in a helix around the elastic yarn. When the fibre is subjected to a tensile force, the resistant yarn is progressively stretched, which has the effect of pushing the elastic yarn. When the resistant yarn comes to be fully stretched, the elastic yarn is found to be wound spirally around the resistant yarn. Such a fibre is said to be auxetic because it has the peculiarity in that its diameter increases when a tension is applied to it.

The document WO2010/146347 emphasises the undesirable behaviour of such a fibre, in particular when it comes to be in a state of elongation less than its state of maximum elongation: the turns of the resistant yarn become separated from the elastic yarn, along with slipping of the turns of the resistant yarn along the elastic yarn, and the destructuring of the fibre itself.

There is therefore a need for a flexible cable that has all of the following characteristics:

- a high maximum rate of elongation, with the cable demonstrating advantageous behaviour over the entire range of rates of elongation,
- a high degree of elasticity at low load,
- a high degree of stiffness at high load, in order to limit the elongations beyond a predetermined level,
- and an ultimate (breaking) load that is high enough, in order to resume the maximum operating loads without damage.

OVERVIEW OF THE INVENTION

One of the objectives of the invention is therefore to overcome the disadvantages mentioned here above, by providing a hybrid cable having a simple and inexpensive design and possessing an elongation curve presenting the following:

- a zone of low load in which the elongation increases rapidly as a function of the load
- and, when the yarn reaches a predetermined maximum rate of elongation, a zone of very high load in which there is almost no longer any increase in elongation.

The hybrid cable must have a high maximum rate of elongation, and advantageous behaviour over the entire range of rates of elongation.

To this end, and in accordance with the invention, a hybrid elastic cable is provided that comprises at least one filament yarn of a first type and at least one filament yarn of a second type, the filament yarn of the first type having a lower degree of tenacity than that of the filament yarn of the second type, and the filament yarn of the second type having a lower degree of elasticity than that of the filament yarn of the first type; the filament yarn of the second type, when a predetermined maximum rate of elongation of the hybrid cable is reached, is fully elongated and the filament yarn of the first type is wound in a helix around the filament yarn of the second type, characterised in that the filament yarn of the first type with the said maximum rate of elongation is wound in a helix around the filament yarn of the second type with a specific number of turns per linear meter of the cable ranging between $n_{sE}-15\%$ and $n_{sE}+15\%$, $n_{sE}$ being determined based on the following formula:

$$n_{sE} = \frac{1000}{\pi(\varphi_e + \varphi_K)} \times \frac{\sqrt{K_{max} \times (K_{max} + 200)}}{K_{max} + 100}$$

in which $\phi_e$ is the diameter in mm of the filament yarn of the first type at rest, $\phi_K$ is the diameter in mm of the filament yarn of the second type, and $K_{max}$ is the predetermined maximum rate of elongation of the hybrid cable, the filament yarn of the first type moreover being also twisted about itself with a specific number of distinct turns about itself per linear meter of the cable ranging between $n_{sE}$ and $3 \times n_{sE}$, with the distinct turns about itself of the filament yarn of the first type being wound in the opposite direction from that of the said helix, in a manner such that when the hybrid cable is at rest, the filament yarn of the second type is wound in a helix around the filament yarn of the first type, substantially without separation of the yarn of the second type or deformation of the hybrid cable.

In other words, the invention consists of winding together two filament yarns having very different mechanical properties, that is to say, one high elasticity filament yarn, and one high tenacity filament yarn, or in a more general manner, one filament yarn with higher elasticity and one filament yarn with higher tenacity, this combination being made such that the two filament yarns are wound, one around the other and vice versa, depending on whether the cable is at rest or in full extension/fully elongated. In order to facilitate proper understanding of the invention, in the remainder of the description, the filament yarn of the first type, that is the filament yarn with higher elasticity shall be qualified as "high elasticity filament yarn", and the filament yarn of the second type, that is the filament yarn with higher tenacity shall be qualified as "high tenacity filament yarn", it being understood that the degrees of elasticity and tenacity are assessed not in absolute terms, but in a relative manner between the two types of filament yarns.

In other words, the invention consists of producing a hybrid cable by combining a high elasticity filament yarn and a high tenacity filament yarn, which are assembled in a manner such that at rest, the high tenacity filament yarn comes to be spirally wound around the high elasticity filament yarn, and that as the elongation of the cable continues progressively, the relative positions of the two filament yarns get reversed, so as to result in a configuration in which from a certain rate of elongation, the high tenacity filament yarn has pushed the high elasticity filament yarn towards the exterior, and such that the latter comes to be spirally wound around the taut high tenacity filament yarn. It is thus to be understood that the hybrid cable according to the invention presents two very different behaviours depending upon the rate of elongation thereof. Thus, it behaves substantially like the high elasticity filament yarn of which it is made up until a predetermined rate of elongation. Then, when the predetermined rate of elongation has been reached, it behaves substantially like the high tenacity filament yarn of which it is made up, that is to say with the characteristic features of the latter. Such a hybrid cable structure also makes it possible to avoid all the wear and tear of the high tenacity filament yarns which when they are stretched taut are found to be almost rectilinear, and work in optimal conditions.

The advantageous behaviour of the hybrid cable is obtained by means of a particular choice of parameters for the cable, and in particular the number of turns in the winding of the two filament yarns twisted around each other.

Thus, in full extension, the hybrid cable according to the invention is in a configuration where the high elasticity filament yarn is wound in a helix around the high tenacity filament yarn with a number of turns per linear meter of the cable ranging between $n_{sE}-15\%$ and $n_{sE}+15\%$. $n_{sE}$ is determined as a function of the diameter of the high elasticity filament yarn, the diameter of the high tenacity filament yarn, and a predetermined maximum rate of elongation, based on the following formula:

$$n_{sE} = \frac{1000}{\pi(\varphi_e + \varphi_K)} \times \frac{\sqrt{K_{max} \times (K_{max} + 200)}}{K_{max} + 100} \quad \text{Formula (F1)}$$

in which $\phi_e$ is the diameter in mm of the of the high elasticity filament yarn at rest, $\phi_K$ is the diameter in mm of the high tenacity filament yarn, and $K_{max}$ is the predetermined maximum rate of elongation, expressed as a percentage.

Preferably the high elasticity filament yarn is wound in a helix around the high tenacity filament yarn with a number of turns per linear meter of the cable ranging between $n_{sE}$−5% and $n_{sE}$+5%, and more preferably between $n_{sE}$−2% and $n_{sE}$+2%.

The fact that the high elasticity filament yarn is coiled about itself—in other words twisted—with a specific number of distinct turns about itself, the distinct turns about itself winding in the opposite direction from that of the helix formed by the high elasticity filament yarn around the high tenacity filament yarn, promotes the winding of the high tenacity filament yarn around the high elasticity filament yarn when the hybrid cable returns from its fully extended configuration to its resting configuration.

The number of distinct turns about itself per linear meter of the cable at the maximum rate of elongation should range between $n_{sE}$ and $3 \times n_{sE}$ preferably between $n_{sE}$ and $2 \times n_{sE}$.

The spiral shape of the high elasticity filament yarn and its deformation when the hybrid cable is released back to its rest configuration guides the high tenacity filament yarn and allows it to arrange itself in an orderly manner around the high elasticity filament yarn.

The various different elements described above, namely the number of turns of the high elasticity filament yarn around the high tenacity filament yarn at the maximum rate of elongation, and the fact that the high elasticity filament yarn is twisted about itself, provides the ability to obtain a hybrid cable with a very wide range of rate of elongation, and displaying advantageous behaviour, in particular when the cable is brought back to resting state.

Here the term advantageous behaviour refers to the fact that, over the entire range of elongation of the hybrid cable, from the resting state to the maximum elongation, the turns of the filament yarn wound in a helix tightly grip the filament yarn in a central position, preventing any relative sliding of the two filament yarns. Furthermore the cable is completely stable and does not tend to twist in one direction or the other. The cable of the invention behaves perfectly both when it undergoes an elongation from resting state to the maximum rate of elongation, as well as vice versa, and this occurs repeatedly.

Conversely, the term undesirable behaviour refers to the fact that the cable has a tendency to twist, or that the turns of the high tenacity filament yarn loses contact with the high elasticity filament yarn in the central position, which leads to the risk of relative sliding between the two filament yarns. The cable is destructurised with considerable slippage between the two filament yarns.

By adhering to the above specifications regarding the number of turns about itself of the high elasticity filament yarn and the number of turns of the high elasticity filament yarn when the hybrid cable is in fully elongated state, it is possible to manufacture a hybrid cable having advantageous behaviour for a range of rates of elongation going from 0 to several hundreds of %. The predetermined maximum degree of the hybrid cable is for example comprised between 100% and 400%, or even between 150% and 300%. The upper limit is defined for example by the number of contiguous turns of the high tenacity filament yarn that it is possible to place over the high elasticity filament yarn in resting state.

In resting state, the hybrid cable according to the invention is in a configuration where the high tenacity filament yarn is wound in a helix around the high elasticity filament yarn, with a number of turns per linear meter of the hybrid cable ranging between $n_{SR}$−15% and $n_{SR}$, +15%, $n_{SR}$ being determined based on the following formula:

$$n_{sR} = \frac{10}{\pi(\varphi_e + \varphi_K)} * \sqrt{K_{max} \times (K_{max} + 200)} \quad \text{Formula (F2)}$$

The number of turns of the high tenacity filament yarn preferably ranges between $n_{SR}$−5% and $n_{SR}$, +5%, between $n_{SR}$−2% and $n_{SR}$+2%.

Thus, the cable possesses the property of passing from one configuration to another, while remaining in a stable state during its cycles of elongation and release.

Preferably, in order to obtain a cable having a marked transition between its two behaviours, that is, a low resistance to elongation, and very high mechanical resistance when stretched, the two filament yarns constituting the hybrid cable are chosen such that they have distinctly different properties. In order to do this, and depending upon the applications, it may be advantageous that the high tenacity filament yarn and the high elasticity filament yarn have moduli of longitudinal elasticity, whose ratio is greater than or equal to 10000. In other applications this ratio may be of the order of 100. Quite obviously, this ratio may be adapted according to the application. Typically this ratio is greater than 100, preferably greater than 1000.

According to another aspect of the invention, it is possible to use for the high elasticity filament yarn and/or the high tenacity filament yarn, yarns consisting of multiple filament yarns or individual mono filaments.

In practice, and depending upon the application, the high elasticity filament yarn may be selected from among the family of elastomers and in particular filament yarn of elastane or natural rubber, or a combination of these filaments or any other filament yarn that meets the specifications required by the particular application.

Furthermore, the high tenacity filament yarn may be selected from among the group consisting of: filament yarns of natural fibres, filament yarns of glass, of carbon, aramid, para-aramid, rayon, or a combination of these filament yarns, or more generally any the filament yarn obtained from a natural or synthetic material that has a higher tenacity than the other filament yarn of the cable, at a level consistent with the desired properties for the domain of properties.

In an advantageous embodiment, the hybrid cable includes at least one so called drawing yarn integrally joined along the said cable, the said drawing yarn having a low elasticity and being adapted to break under the effect of a predetermined load.

This facilitates the use of the hybrid cable in textile machines, for example weaving machines. The extension of the cable is limited by the drawing yarn during the manufacture.

In this case, the drawing yarn is preferably integrally joined to the said cable by means of at least one so called wrapping elastic filament yarn wound in a helix around the filament yarn of the first type, the filament yarn of the second type and the drawing yarn.

In an advantageous embodiment, the rate of elongation varies along the cable when the drawing yarn is tensioned, and preferably varies in a continuous manner. These rates of elongation are called "intermediate rates of elongation" in the following sections.

In an exemplary embodiment, the intermediate rate of elongation along a first section is substantially constant at a first value. The intermediate rate of elongation along a second section is substantially constant at a second value. The transition between the first value of the rate of elongation and the second value of rate of elongation occurs over a relatively short length of cable.

In another exemplary embodiment, the intermediate rate of elongation along the first section varies in a continuous manner according to a predetermined rule, for example decreases in a continuous manner. The intermediate rate of elongation along the second section is substantially constant or varies in a continuous manner according to a predetermined rule.

Thus this hybrid cable has sections presenting different intermediate elongations when the drawing yarn is tensioned. If the cable is used for making a woven article, this article includes zones where cable has a higher intermediate elongation, and zones where the cable has a lower intermediate elongation. Once the drawing yarn is broken, the zones where the cable has a higher intermediate elongation will present a lower elasticity than the zones where the cable has a lower intermediate elongation. This property can be used to control the expansion of woven articles.

In another advantageous embodiment, the predetermined maximum rate of elongation varies along the cable. The cable is then typically free of the drawing yarn.

This variable maximum rate of elongation is obtained by causing the varying, along the cable, of the number of turns of the high elasticity filament yarn wound in a helix around the high tenacity filament yarn per linear meter of the hybrid cable. This is done at the time of manufacture. This number of turns is selected in a manner so as to satisfy the criterion regarding the number of turns of the high elasticity filament yarn set out above.

The number of turns of the high elasticity filament yarn about itself is also caused to vary, if necessary, so as to comply with the criterion set out above.

The cable itself may also be used for producing woven articles. It provides the ability to create in this article more elastic zones where the cable has a higher maximum rate of elongation, and lower elasticity zones where the cable has a lower maximum rate of elongation. This property can be used to control the expansion of woven articles.

By way of a variant, a drawing yarn is subsequently added to the cable, without modification of the rates of elongation of the various sections of the cable.

In any event, the criteria with respect to the number of turns about itself and the number of turns of the high tenacity filament yarn are complied with at all points of the cable.

Another object of the invention relates to a process for manufacturing an elastic hybrid cable having the characteristic features mentioned above, the process comprising the following steps of:

winding in a helix, of the filament yarn of the first type stretched around the tensioned filament yarn of the second type, with a number of turns per linear meter of the cable ranging between $n_{sE}-15\%$ and $n_{sE}+15\%$, $n_{sE}$ being determined based on the following formula:

$$n_{sE} = \frac{1000}{\pi(\varphi_e + \varphi_K)} \times \frac{\sqrt{K_{max} \times (K_{max} + 200)}}{K_{max} + 100}$$

in which $\phi_e$ is the diameter in mm of the filament yarn of the first type at rest, $\phi_K$ is the diameter in mm of the filament yarn of the second type and $K_{max}$ is the predetermined maximum rate of elongation of the hybrid cable, twisting of the filament yarn of the first type about itself with a specific number of turns about itself per linear meter of the cable ranging between $n_{sE}$ and $3 \times n_{sE}$, the turns about itself of the of the filament yarn of the first type being wound in the opposite direction from the turns of the said helix.

Optionally, the method comprises a step of releasing the tension applied to the hybrid cable, in a manner such that the contraction of the filament yarn of the first type causes the filament yarn of the second type to be set in a configuration where it is wound in a helix around the filament yarn of the first type.

Advantageously, a strand is obtained upon conclusion of the steps of winding and twisting, the process further comprising the step of integrally joining at least one so called drawing yarn along the said strand, the said drawing yarn having a low elasticity and being adapted to break under the effect of a predetermined load, the step of integrally joining being carried out after the steps of winding and twisting.

Preferably, during the step of integrally joining, the rate of elongation of the section of the strand to which the drawing yarn is integrally joined is caused to be varied. The said section here corresponds to the section to which the drawing yarn is in the process of being integrally joined. This is achieved by ensuring varying of the ratio between the speed of unwinding imposed on the strand and the speed of unwinding imposed on the drawing yarn during the integrally joining step. This provides the ability to obtain a cable in which the intermediate rate of elongation varies along the cable.

As mentioned above, the rate of elongation may be constant or may vary in a continuous manner along the strand, or vary in incremental steps, etc.

According to a third aspect, the invention relates to a manufactured object comprising at least one hybrid elastic cable having the abovementioned characteristic features.

For example the manufactured object comprises a sleeve woven making use of the hybrid cable, the hybrid cable including at least one so called drawing yarn integrally joined along the said cable, the sleeve comprising a plurality of warp yarns, the hybrid cable forming the weft yarn, the cable presenting at least first and second sections, the cable having first intermediate rates of elongation along the first section when the drawing yarn is tensioned, the cable having along the second section second intermediate rates of elongation lower than the first intermediate degrees of elongation when the drawing yarn is tensioned, the first section of the cable being an end section defining an end portion of the sleeve, the second section defining a central portion of the sleeve.

Advantageously, the cable has third intermediate rates of elongation along a second end section when the drawing yarn is tensioned, the second intermediate rates of elongation being lower than the third intermediate rates of elongation, the said second end section defining a second end of the sleeve.

For example, the first intermediate rate of elongation increases in a continuous manner from the free end of the hybrid cable up to the central section. Similarly, the third intermediate rate of elongation increases in a continuous manner, from the free end of the hybrid cable up to the central section. Typically, the second intermediate rate of elongation remains constant along the second section.

In another embodiment, the cable used to make the sleeve does not include the drawing yarn. The cable is of the type having a variable maximum rate of elongation, as described above. The said first section of the cable presents relatively lower maximum rates of elongation, while the said central section presents relatively higher maximum rates of elongation, and the said third section of the cable presents relatively lower maximum rates of elongation.

As before, the first maximum rate of elongation increases in a continuous manner from the free end of the hybrid cable up to the central section. Similarly, the third maximum rate of elongation increases in a continuous manner from the free end of the hybrid cable up to the central section. Typically, the second maximum rate of elongation remains constant along the second section.

At rest, the sleeve has a tubular shape. When the sleeve is expanded, the first section and the third section expand radially to a lesser extent than the second section. A sleeve having a cylindrical shape at rest adopts, after expansion, a spindle like shape, tapered at both its ends.

Advantageously the object includes an inflatable bladder, the sleeve being fitted around the bladder. The bladder may advantageously be inflated and cause expansion of the sleeve. The sleeve deforms in a controlled manner, which prevents the creation of wart like bumps on the bladder, at the first and second end of the sleeve.

SUMMARY DESCRIPTION OF THE FIGURES

Other advantages and characteristic features will become clearly apparent from the description which follows, from the several variant embodiments, given by way of non-limiting examples, of the hybrid cable according to the invention, with reference made to the accompanying drawings in which.

DETAILED DESCRIPTION OF THE INVENTION

Figure 1A:
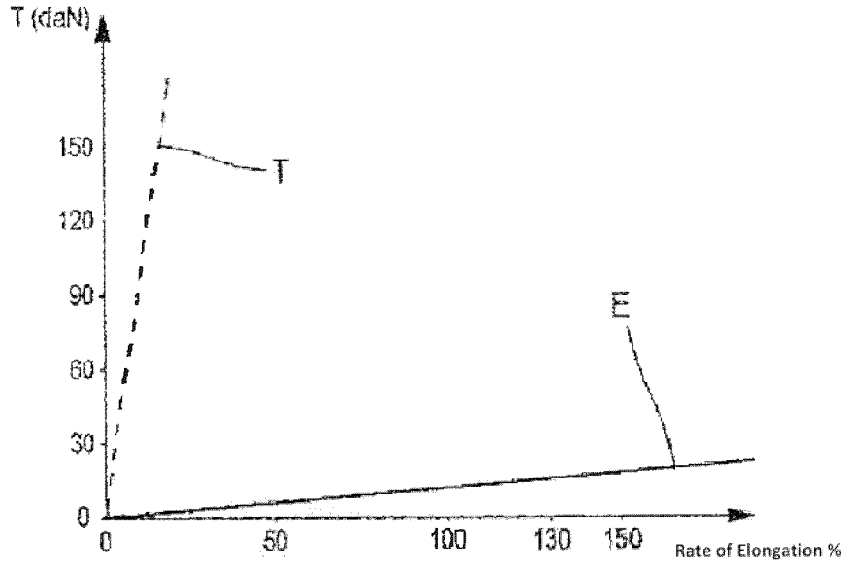
FIG. 1A PRIOR ART
FIG. 1A is a graph showing the tensile strength of a central core as a function of the rate of elongation by the curve E and the tensile strength as a function of the rate of elongation of a sheath by the curve T, of a conventional hybrid cable.
Figure 1B:
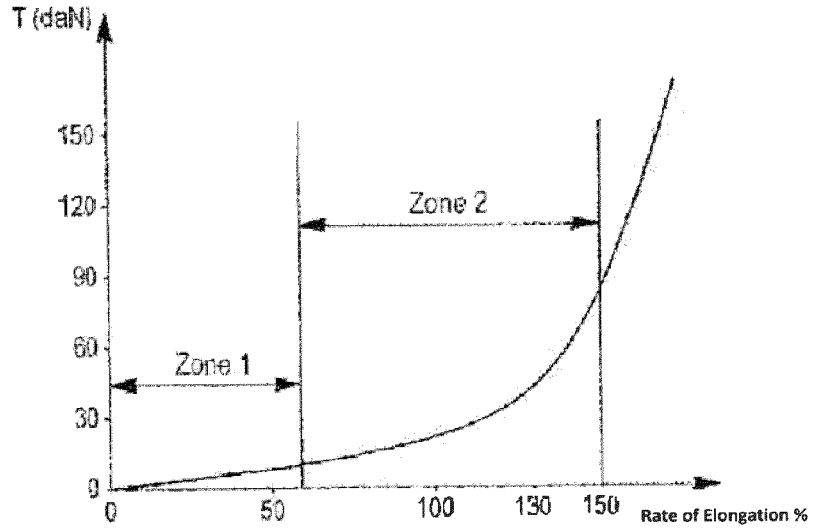
FIG. 1B PRIOR ART
FIG. 1B is a graph showing the tensile strength as a function of the rate of elongation, of a typical hybrid cable.

For the purposes of clarity, in the remainder of the description, the same elements have been designated with the same reference numerals in the different figures. In addition, the various sectional views are not necessarily drawn to scale and the dimensions of the elements may have been exaggerated to facilitate proper understanding of the invention.

Composition and Constitution of the Cable

Figure 2:
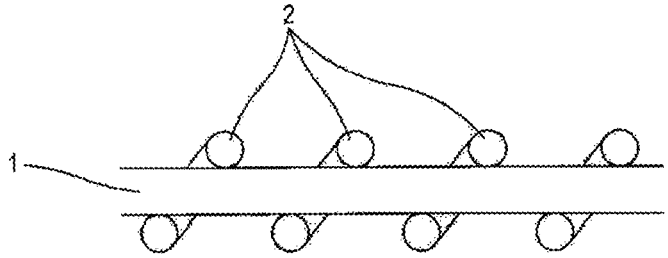
FIG. 2 is a schematic longitudinal sectional view of a hybrid cable in accordance with the invention.

With reference to FIG. 2, the hybrid cable according to the invention is constituted from a high elasticity filament yarn (1) and a high tenacity filament yarn (2) which, when the hybrid cable is in a resting state, is wound in a helix around the high elasticity filament yarn (1).

The high elasticity filament yarn (1) may be selected from the yarns of the following group: elastomeric filament yarns such as filament yarns of polyurethanes, elastane filament yarns, or a combination of these yarns and the high tenacity filament yarn (2) may be selected from the yarns of the following group: filament yarns of natural fibres such as cotton, flax or hemp yarns for example, glass filament yarns, carbon filament yarns, aramid yarn, para-aramid filament yarns, rayon filament yarns, or a combination of these yarns.

Preferably, the high tenacity filament yarn (2) and the high elasticity filament yarn (1) have a ratio between their moduli of elasticity greater than or equal to 10000. However, it is quite obvious that the ratio of the moduli of elasticity of the high tenacity filament yarn (2) and high elasticity filament yarn (1) may have any value depending upon the field of application of the elastic cable according to the invention.

Moreover, it is indeed obvious that the high elasticity filament yarn (1) and the high tenacity filament yarn (2) could be respectively constituted of a plurality of elastic yarns and high tenacity yarns respectively, without in any way departing from the scope of the invention.

Figure 12:
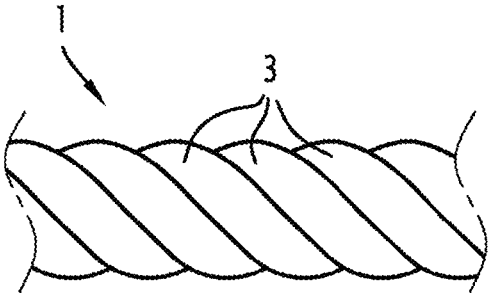
FIG. 12 is an enlarged view of the high elasticity filament yarn shown in FIGS. 4A to 4D.

As shown in FIG. 12, the high elasticity filament yarn 1 is twisted about itself, and forms a plurality of turns referred to below as turns about itself 3.

According to a particular embodiment of the invention, the high elasticity filament yarn (1) is constituted from a natural rubber yarn whose modulus of longitudinal elasticity is about 2 MPa and whose diameter at rest is equal to 1.1 mm. The high tenacity filament yarn (2) is constituted from an aramid yarn having a linear density of 3300 dtex, marketed under the brand name Kevlar®, for example, of which the modulus of longitudinal elasticity is equal to about 30000 MPa and the diameter is equal to 0.6 mm. For a maximum rate of elongation $K_{,max}$=150%, the formula (F1) outlined here above gives the number of turns $n_{sE}$ equal to 170.

Operation

Figure 3:
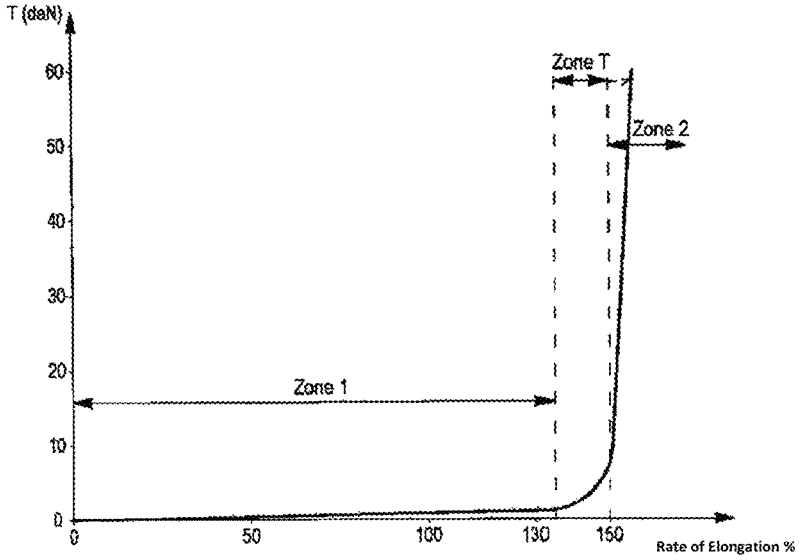
FIG. 3 is a graphical representation of the load of the filament yarn as a function of its elongation.

With reference to FIG. 3, it may be noted that the curve of elongation of the hybrid cable according to the invention has a low load zone (Zone 1), extending over the range 0% to 140%, of rate of elongation, in which the elongation increases rapidly as a function of the load. When the filament yarn reaches the predetermined maximum rate of elongation, that is $K_{max}$=150%, the curve shows a very high load zone (Zone 2) in which there is almost no longer any increase in elongation.

Between these two zones (Zone 1, Zone 2), the curve has a short transition zone (Zone T), extending over the range 140% to 150% of rate of elongation, within which the behaviour of the cable shifts progressively from elastic behaviour to resistant behaviour, and vice versa.

Thus, the hybrid cable according to the invention behaves like an elastic whose elasticity is constant up to a predetermined elongation and, when the said predetermined elongation level has been reached, behaves like a high tenacity filament yarn, that is to say, demonstrating a very low elongation and very high resistance before breaking.

The evolving change in the behaviour of the cable may be understood upon examining the change in its configuration during its progressive elongation, with reference to FIGS. 4A to 4D. In order to visualise the elongation of the hybrid cable, a particular point of the cable has been highlighted by an identifying flag shaped reference marker (8), which shifts along with the elongation.

Figure 4A:
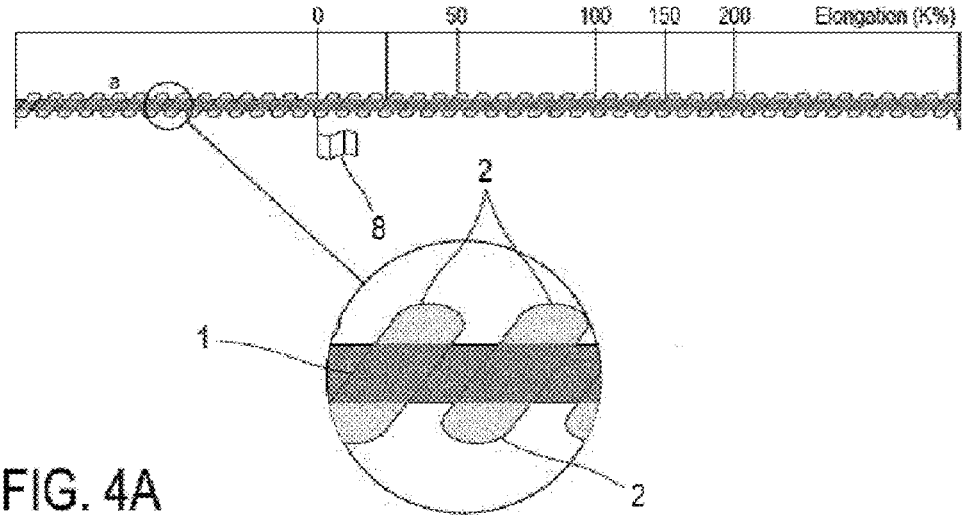
FIGS. 4A to 4D are schematic longitudinal sectional views from the side of the hybrid cable according to the invention at a rate of elongation of 0%, 75%, 140% and 147% respectively.

Thus, more precisely, and with reference to FIG. 4A, the hybrid cable at rest is presented in a configuration where the core is constituted by the high elasticity filament yarn (1) around which is wound in a helix the high tenacity filament yarn (2), with a number of turns $n_{SR}$ in the example shown.

Figure 4B:
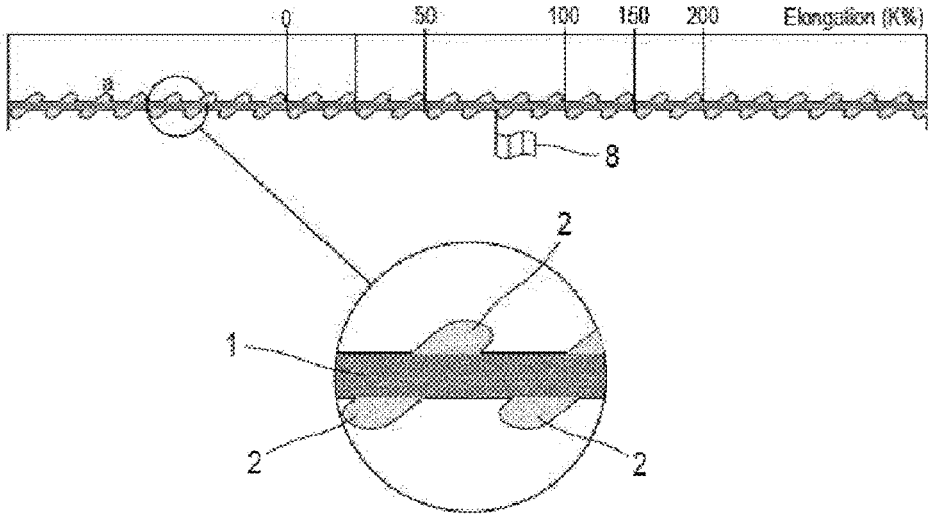
Figure 4C:
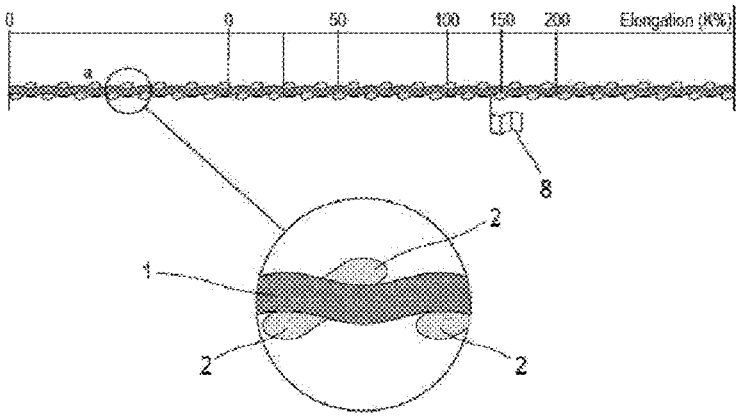

Within the range of elongation corresponding to the zone 1, with reference to FIG. 4B, the progressive elongation of the hybrid cable which is visualised through the shifting of the reference marker (8) translates into an identical elongation of the core consisting of the high elasticity filament yarn (1). The pitch of the turns of the helix formed by the high tenacity filament yarn (2) is increased by a similar degree of expansion. The resistance demonstrated by the high tenacity filament yarn (2) over the course of this elongation of its turns is almost zero, such that over the first phase of extension, the tensile strength of the hybrid cable is substantially equal to that of the high elasticity filament yarn (1).

This process continues until the rate of elongation of the hybrid cable is such that the high tenacity filament yarn comes to be in a state close to its full elongation state, that is to say about 140% in this exemplary embodiment. From this rate of elongation corresponding to the beginning of the zone of transition (zone T), with reference to FIG. 4C, it is found that the high tenacity filament yarn (2) forces the elastic filament yarn (1), which was rectilinear until that point, to take the form of a helix. The high tenacity filament yarn (2) and the high elasticity filament yarn (1) then form a double helix. This process continues over the short percentage range of the additional elongation corresponding to the transition range, that is to say the elongation range between 140% and 150% in the example illustrated.

Figure 4D:
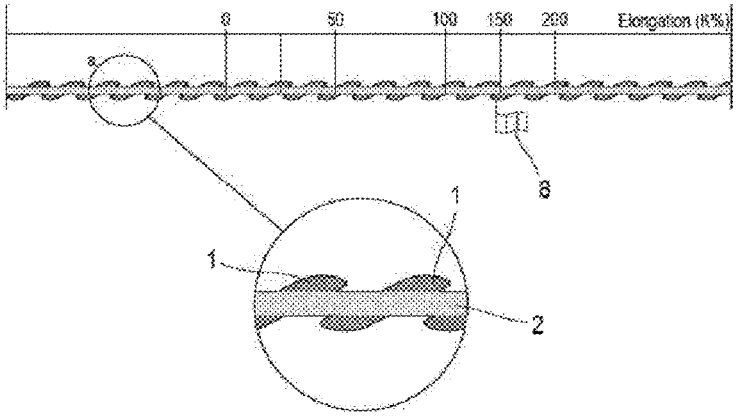

At the end of the zone of transition, with reference to FIG. 4D, the high tenacity filament yarn (2) reaches its state of full elongation and then constitutes the core of the hybrid cable, with the high elasticity filament yarn (1) being found to be wound in a helix around the high tenacity filament yarn (2), with a number of turns that amounts to $n_{sE}$ in the example shown. Starting from this configuration, and up until the breaking point, the behaviour of the elastic cable is almost identical to that of the high tenacity filament yarn (2).

The high elasticity filament yarn (1) presents a specific number of turns about itself per linear meter of the cable that is double the number of turns formed by the high elasticity filament yarn (1) around the high tenacity filament yarn in the state of full elongation. The turns about itself of the high elasticity filament yarn (1) are wound in the opposite direction from the turns of the helix formed by the high elasticity filament yarn around the high tenacity filament yarn.

Manufacture

In a general manner for the assembly: the high tenacity filament yarn is brought into a state of full elongation, with a tension at least equal to that which corresponds to the beginning of the transition zone. The elastic yarn is brought to a rate of elongation substantially equal to the maximum rate of elongation desired for the hybrid cable. The twisting of the hybrid cable may be achieved by using either one or the other of various conventional processes for the twisting of cables: single twisting, double twisting, direct winding in particular.

Figure 5:
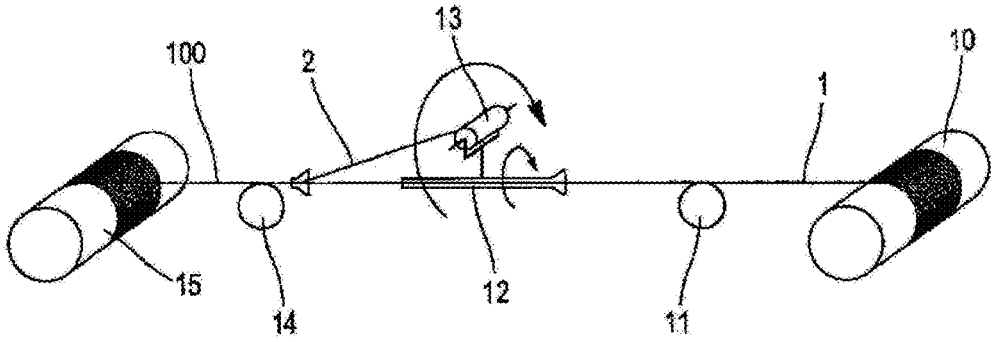
FIG. 5 is a simplified representation of a device for the manufacture of a hybrid cable in accordance with the invention.

With reference to FIG. 5 which presents an assembling and twisting device in particular, the high elasticity filament yarn (1) that was previously stretched and twisted is unwound from a reel (10) equipped with a braking apparatus, the filament yarn then passes into a drive unit consisting of a motorised roller (11) and then through a hollow spindle (12) then through a ceramic assembly disc (9) where the assembly with the high tenacity filament yarn is carried out, the assembled cable then being subsequently driven by the motorised roller (14). Proper setting and adjustment of the braking apparatus of the reel (10) and of the speed of rotation of the roller (11) relative to that of the roller (14) ensures the ability to deliver the high elasticity filament yarn to the ceramic assembly disc (9) for assembly with a rate of elongation equal to the maximum rate of elongation desired for the hybrid cable.

The high tenacity filament yarn (2) is unwound from the reel (13), which is mounted on the hollow spindle (12). This filament yarn (2) passes through the ceramic pellet (8) where the assembly with the high elasticity filament yarn (1) is carried out. The tensioning of the high tenacity filament yarn (2) is performed by a braking system built in to the reel (13). The speed of rotation of the hollow spindle (12) over which the reel (13) is fixed is adjusted depending on the speed of rotation of the roller (14) in order to ensure the appropriate adjusting of the number of turns $n_{sE}$, as calculated in accordance with the formula (Formula 1).

The hybrid cable (100) is driven by the roller (14) so as to be rewound onto a reel (15), at a tension level compatible with the subsequent uses.

Figure 6:
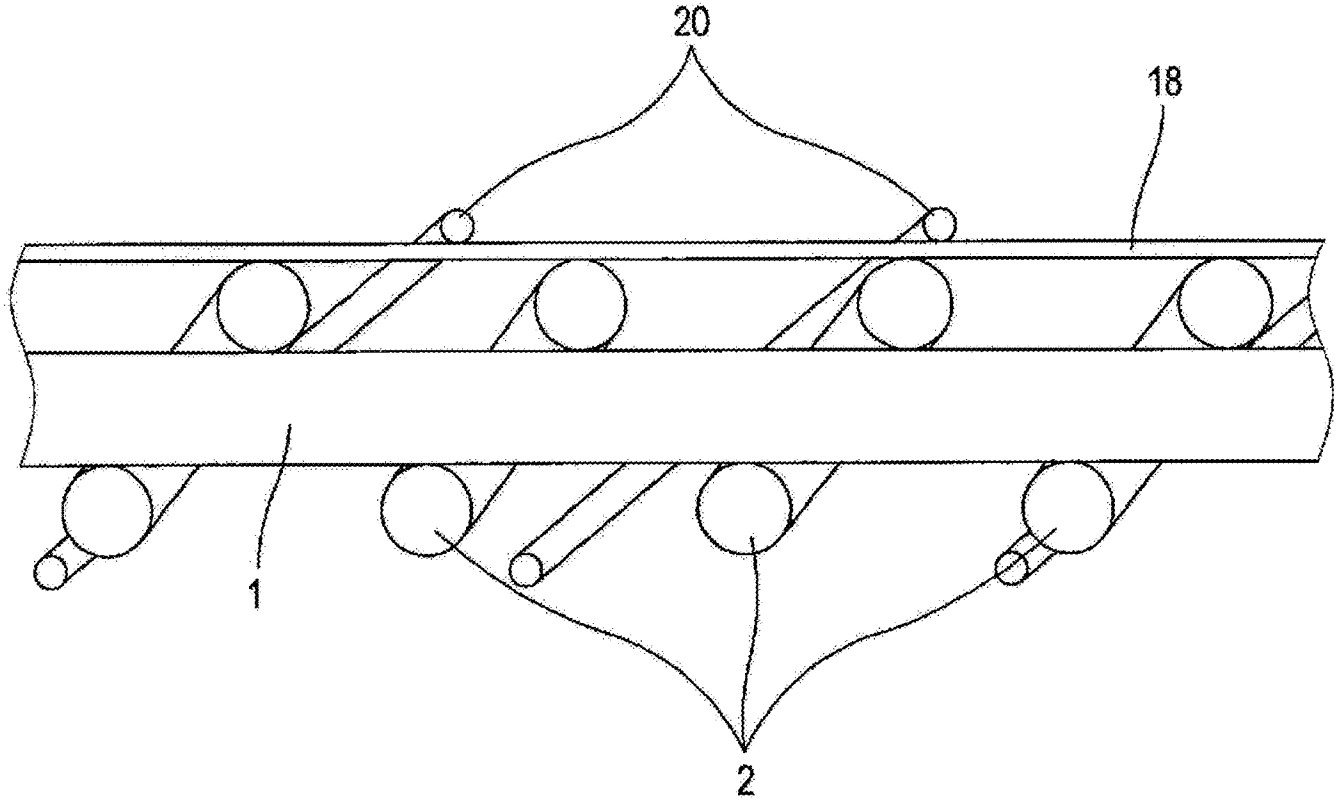
FIG. 6 is a schematic longitudinal sectional view of a variant embodiment of the hybrid cable in accordance with the invention.

With reference to FIG. 6, a variant embodiment provides the ability to produce a wrapped hybrid cable (200) having a strand composed of the high tenacity filament yarn (2) and the high elasticity yarn (1) arranged as described above, with which is combined a drawing yarn, having a low elasticity and being adapted to break under the effect of a predetermined load. Preferably the drawing yarn (18) may be formed by one filament yarn or a plurality of filament yarns obtained in the same material as the high tenacity filament yarn (2) or in a material presenting a substantially equal modulus of longitudinal elasticity, an aramid filament yarn for example, and having a diameter substantially smaller than the diameter of the said high tenacity filament yarn (2) and therefore a breaking resistance substantially less than that of the said filament yarn (2). It is also possible to use a soluble yarn, which is placed under the appropriate conditions so as to ensure its dissolution when it is no longer useful.

This wrapped hybrid cable (200) includes the drawing yarn (18) extending substantially parallel to the high elasticity filament yarn (1) forming the core of the cable, and an elastic wrapping yarn (20) wound in a helix around the assembly with a conventional number of turns, typically comprised between 60 and 200 per linear meter.

The addition of the drawing yarn serves the objective of setting in a precise manner an intermediate rate of elongation of the wrapped hybrid cable (200). In effect, when the drawing yarn is tensioned, the strand—and thus the hybrid cable—is in a partially stretched state, corresponding to the intermediate rate of elongation. Thus is fixed the magnitude of elongation between the intermediate state of the cable, wherein the drawing yarn is tensioned, and the state of full elongation, wherein the high tenacity filament yarn is fully tensioned. This state of full elongation is reached after the breaking of the drawing yarn. It should be noted that this setting adjustment can be done with great precision and with great latitude on the rate of elongation of the strand before combination with the drawing yarn. The adjustment is obtained by choosing the ratio between the speed of unwinding imposed on the strand and the speed of unwinding imposed on the drawing yarn.

Figure 7:
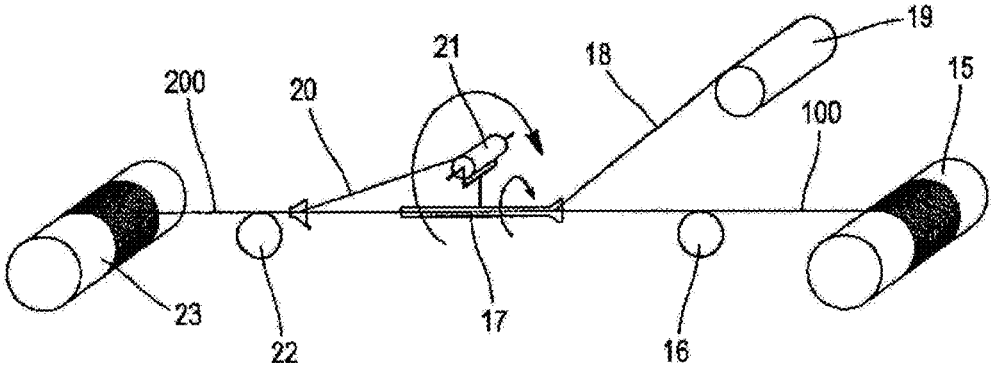
FIG. 7 is a simplified representation of a device for manufacturing the hybrid cable shown in FIG. 6.

With reference to FIG. 7, the strand (100) is unwound from the reel (15) equipped with a braking apparatus; the strand (100) then passes into a drive unit consisting of a motorised roller (16), and then through a hollow spindle (17), then through a ceramic assembly disc (24) where the assembly with the drawing yarn is carried out, the assembled cable then being subsequently driven by the motorised roller (22). Appropriate braking of the reel (15) ensures the ability to bring the strand (100) on to the roller (16) in its state of maximum elongation. Proper adjustment of the speed of rotation of the roller (16) relative to that of the roller (22) ensures the ability to deliver the strand (100) with the intermediate rate of elongation desired at its point of assembly with the drawing yarn.

The drawing yarn is unwound from the reel (19) equipped with a braking apparatus. It passes through the hollow spindle and then through the assembly disc (24) where the assembly is carried out. The brake of the reel (19) is set in a manner such that the drawing yarn is delivered in a state of full elongation at the point of assembly.

An elastic filament yarn (20) having a small diameter is unwound from the reel (21) integrally secured to the hollow spindle (17) which is driven in rotation. The elastic filament yarn (20) passes through the ceramic assembly disc (24) where the wrapping takes place, by the elastic filament yarn (20), wrapping around the strand (100) and the drawing yarn (18) so as to form the wrapped hybrid cable (200). This cable (200) is driven by the roller (22), and then delivered, with the intermediate rate of elongation on to the storage reel (23).

Obviously the drawing yarn (18) may be integrally joined to the strand (100) that is to say, to the high elasticity filament yarn (1) and the high tenacity filament yarn (2) by any other means known to the person skilled in the art, such as by bonding or otherwise, without departing from the scope of the invention.

Furthermore, it goes without saying that the wrapped elastic cable (200) may be continuously obtained without requiring the strand (100) to be spooled on to a reel (15), that is to say directly downstream of the operation of assembling the high elasticity and high tenacity filament yarns.

Figure 8:
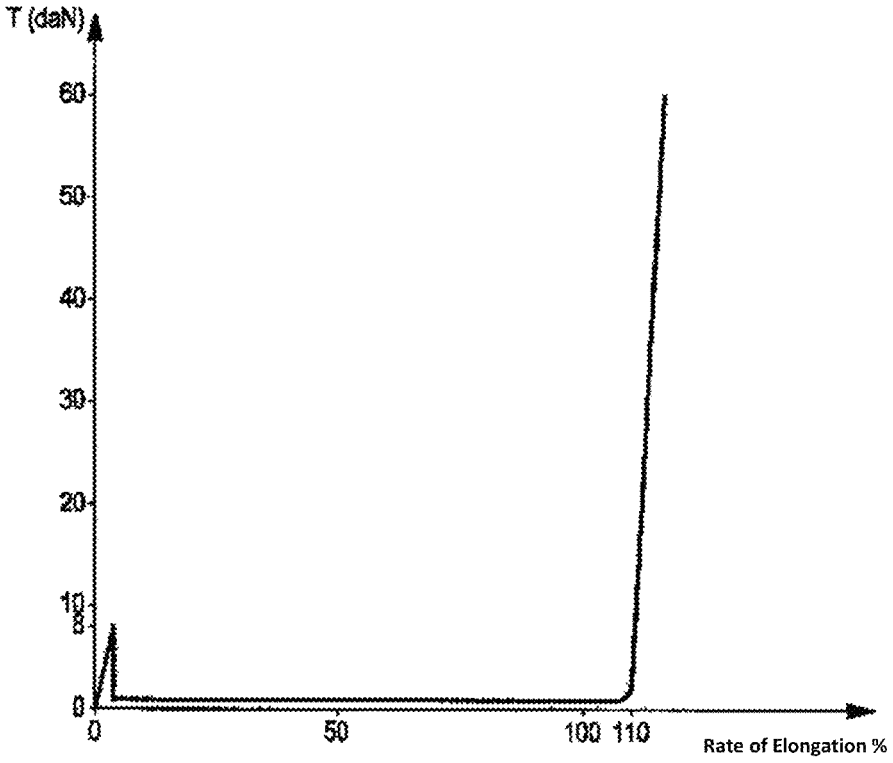
FIG. 8 is a graphical representation of the load of the hybrid cable shown in FIG. 6.

With reference to FIG. 8, the elongation curve of the wrapped hybrid cable clearly shows a first tension peak at low elongation which corresponds to the tensioning of the drawing yarn (18). In this particular example, the breaking of the drawing yarn occurs at a tension of about 8 daN, at very low elongation. After the breaking of the drawing yarn (18), the resistance of the hybrid cable returns to a very low value, of the order of a few Newton which corresponds to the resistance of the high elasticity filament yarn (1) forming the core of the elastic cable. The cable then behaves in the same way as the hybrid cable having no drawing yarn (18). Thus, the curve then presents a zone of low load in which the elongation increases rapidly as a function of the load and, when the filament yarn reaches the predetermined maximum rate of elongation, that is 110%, a zone of very high load in which there is almost no longer any increase in elongation.

This drawing yarn (18) integrally joined to the hybrid cable ensures the ability to easily implement the hybrid cable, with an intermediate elongation determined by the drawing yarn during the various operations necessary for its uses, such as weaving, knitting or drawing, for example.

It also makes it possible to maintain a fixed form of a cable or a fabric obtained from at least one cable according to the invention until the moment where the elastic properties are expressed, by the breaking of the drawing yarn, such that beyond a predetermined stress level, the cable or the fabric can unfold freely until the final extension limit of the elastic cable.

Figure 9:
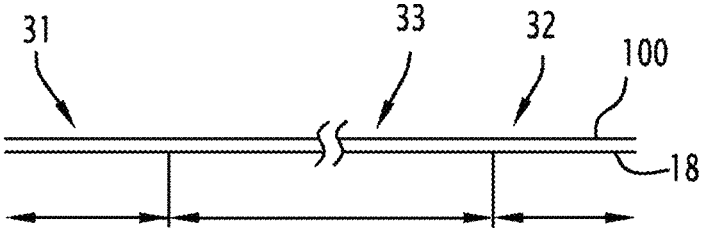
FIG. 9 is a simplified schematic representation of a cable with a drawing yarn and a plurality of sections having rates of elongation that are different from each other when the drawing yarn is tensioned.

In the variant embodiment shown in FIG. 9, the hybrid cable is of the type shown in FIG. 6. It comprises a strand (100) with a high elasticity filament yarn and a high tenacity filament yarn arranged according to the invention, a drawing yarn (18) and an elastic filament yarn (not shown) securing the drawing yarn to the strand (100). The hybrid cable includes first and second end sections (31, 32), connected to each other by a central section (33). The cable (200) has first intermediate rates of elongation along the first end section (31) when the drawing yarn (18) is tensioned. The cable (200) has along the central section (33) the second intermediate rates of elongation that are lower than the first when the drawing yarn (18) is tensioned. The cable (200) has third intermediate rates of elongation along the second end section (32) when the drawing yarn (18) is tensioned, the second intermediate rates of elongation being lower than the third. In other words, the intermediate rate of elongation of the hybrid cable is variable along the hybrid cable. The first intermediate rate of elongation increases in a continuous manner along the first end section, from the free end of the cable towards the central portion. Similarly, the third intermediate rate of elongation increases in a continuous manner along the second end section from the free end of the cable towards the central portion. The intermediate rate of elongation is substantially constant along the central section.

Such a cable is obtained by ensuring varying of the setting of the speed of rotation of the roller (16) relative to that of the roller (22) during manufacture, in a manner so as to deliver the strand (100) with the rate of elongation desired at the point of assembly thereof with the drawing yarn, and more precisely by varying the ratio between the speed of unwinding imposed on the strand and the speed of unwinding imposed on the drawing yarn.

The elastic cable according to the invention will find numerous applications such as for example, for the production of belting and straps or bungee cords or the manufacture of inflatable sleeves or "packer" used in logging or in exploitation of sub surface resources in particular. It has particular application for producing a reinforcing sheath for a packer of the type described in the patent application PCT/FR2007/052534.

Figure 10:
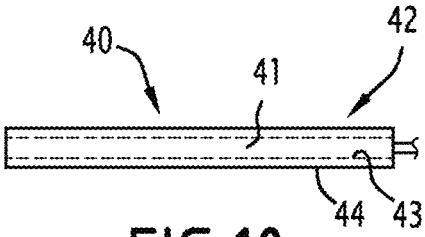
FIGS. 10 and 11 are simplified schematic representations of an assembly comprising of a bladder and a woven sleeve with the cable shown in FIG. 9, respectively in rest and expanded states.
Figure 11:
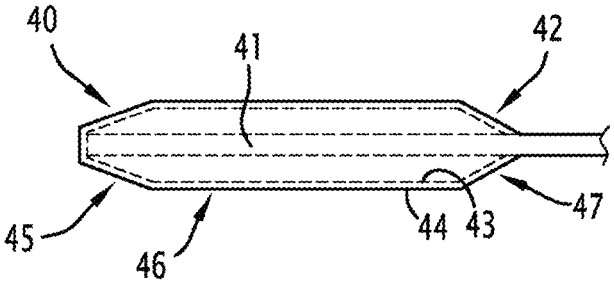

A packer is represented in a simplified manner in FIGS. 10 and 11. This packer (40) comprises a mandrel (41) extending in a longitudinal direction, and a sealed and inflatable annular casing envelope (42) fitted around the mandrel (41). The casing envelope (42) is rigidly connected to the mandrel (41) by rings not shown, disposed at the two longitudinal ends of the casing envelope.

The casing envelope (42) comprises an inflatable and sealed bladder (43) (the broken lines in FIGS. 10 and 11), and a sleeve (44) (solid lines in FIGS. 10 and 11) fitted around the bladder (43).

The internal volume of the bladder is in communication with a source of pressurised gas, not shown, by means of passages in the mandrel (41). The casing envelope (42) is thus capable of selectively adopting a retracted state around the mandrel (41) (FIG. 10) and a radially expanded state (FIG. 11).

The sleeve (44) is woven, and therefore comprises a plurality of longitudinal warp yarns and a weft yarn interlaced with the warp yarns. The weft yarn is a hybrid cable of the type shown in FIG. 9. The first end section (31) of the cable is used for weaving a first end portion (45) of the sleeve, the second section (33) for weaving a central portion (46) of the sleeve, and the second end section (32) of the cable for weaving an end portion (47) of the sleeve.

The sleeve (44) is woven by interlacing the warp yarns with the weft yarn, in a manner known per se. This operation is performed using the hybrid cable (200) in a state of elongation where the drawing yarn (18) is tensioned.

It follows therefrom that the first and second end portions (45, 47) of the sleeve are made with a weft yarn having the first and third intermediate rates of elongation varying in a continuous manner, while the central portion is formed with a weft yarn having a constant second intermediate rate of elongation, which is lower than the first and third intermediate rates of elongation.

When the casing envelope passes into its expanded state, the guide yarn of the hybrid cable is broken, which allows the hybrid cable to extend to its maximum rate of elongation. The first and second end portions (45, 47) are then subjected to a lesser degree of radial expansion than the central portion (46). Indeed, the ratio between the intermediate rate of elongation and maximum rate of elongation is higher for the central section (33) than for the two end sections (31, 32) of the hybrid cable.

The sleeve will therefore adopt a bladder form, as shown in FIG. 11. The end portions (45, 47) have increasing cross sections when they are longitudinally followed, from the end of the sleeve to the central section (46). The central section (46) has a substantially constant cross section. For example the end sections have frustoconical shapes and the central section has a cylindrical shape.

The bladder in the expanded state of the casing envelope, fills the sleeve and has substantially the same shape as the latter. The two longitudinal ends of the bladder thus present no zones where the material constituting the bladder is excessively stretched (warts), which might cause the rupture of the bladder over time.

What is claimed is:

1. A hybrid elastic cable comprising at least one filament yarn of a first type and at least one filament yarn of a second type, the at least one filament yarn of the first type having a lower degree of tenacity than that of the at least one filament yarn of the second type, and the at least one filament yarn of the second type having a lower degree of elasticity than that of the at least one filament yarn of the first type; the at least one filament yarn of the second type, when a predetermined maximum rate of elongation of the hybrid elastic cable is reached, is fully elongated and the at least one filament yarn of the first type is wound in a helix around the at least one filament yarn of the second type, wherein the at least one filament yarn of the first type with said predetermined maximum rate of elongation is wound in a helix around the at least one filament yarn of the second type with a specific number of turns per linear meter of the hybrid elastic cable ranging between $n_{sE}-15\%$ and $n_{sE}+15\%$, $n_{sE}$ being determined based on the following formula:

$$n_{sE} = \frac{1000}{\pi(\varphi_e + \varphi_K)} \times \frac{\sqrt{K_{max} \times (K_{max} + 200)}}{K_{max} + 100}$$

in which $n_{sE}$ is a number of turns per meter for the at least one filament yarn of the first type, $\phi_e$ is the diameter in mm of the at least one filament yarn of the first type at rest, $\phi_K$ is the diameter in mm of the at least one filament yarn of the second type, and $K_{max}$ is the predetermined maximum rate of elongation of the hybrid elastic cable, the at least one filament yarn of the first type moreover being also twisted about itself with a specific number of distinct turns about itself per linear meter of the hybrid elastic cable ranging between $n_{sE}$ and $3 \times n_{sE}$, with the distinct turns about itself of the at least one filament yarn of the first type being wound in the opposite direction from that of the said helix, in a manner such that when the hybrid elastic cable is at rest, the at least one filament yarn of the second type is wound in a helix around the at least one filament yarn of the first type, without the separation of the at least one filament yarn of the second type from the at least one filament yarn of the first type or deformation of the hybrid elastic cable.

2. The hybrid elastic cable according to claim 1 wherein, at rest, the number of turns of the at least one filament yarn of the second type wound in a helix around the at least one filament yarn of the first type per linear meter of the hybrid elastic cable ranges between $n_{sR}-15\%$ and $n_{sR}$, $+15\%$, $n_{sR}$ being determined based on the following formula:

$$n_{sR} = \frac{10}{\pi(\varphi_e + \varphi_K)} * \sqrt{K_{max} \times (K_{max} + 200)}$$

in which $n_{sR}$ is a number of turns per meter for the at least one filament yarn of the second type, $\phi_e$ is the diameter in mm of the at least one filament yarn of the first type at rest, $\phi_K$ is the diameter in mm of the at least one filament yarn of the second type, and $K_{max}$ is the predetermined maximum rate of elongation of the hybrid elastic cable.

3. The hybrid elastic cable according to claim 1, wherein the at least one filament yarn of the second type and the at least one filament yarn of the first type have moduli of longitudinal elasticity, whose ratio is greater than or equal to 10000.

4. The hybrid elastic cable according to claim 1 wherein the at least one filament yarn of the first type is selected from the yarns of the following group: elastomeric filament yarns such as natural rubber filament yarns, elastane filament yarns, or a combination of these yarns.

5. The hybrid elastic cable according to claim 1, wherein the at least one filament yarn of the second type selected from the yarns of the following group: filament yarns of natural fibres, glass filament yarns, carbon filament yarns, filament yarns of organic fibres such as aramid, para-aramid, polyester, polypropylene, polyamide, of aramid or a combination of these yarns.

6. The hybrid elastic cable according to claim 1, wherein it includes at least one drawing yarn integrally joined along said hybrid elastic cable, the said drawing yarn having a low elasticity and being adapted to break under the effect of a predetermined load.

7. The hybrid elastic cable according to claim 6 wherein the drawing yarn is integrally joined to said hybrid elastic cable by means of at least one wrapping elastic filament yarn wound in a helix around the at least one filament yarn of the first type, the at least one filament yarn of the second type and the drawing yarn.

8. The hybrid elastic cable according to claim 6, wherein the rate of elongation varies along the hybrid elastic cable when the drawing yarn is tensioned, and varies in a continuous manner.

9. The hybrid elastic cable according to claim 1, wherein the predetermined maximum rate of elongation varies along the hybrid elastic cable.

10. A process for manufacturing a hybrid elastic cable comprising at least one filament yarn of a first type and at least one filament yarn of a second type, the at least one filament yarn of the first type having a lower degree of tenacity than that of the at least one filament yarn of the second type, and the at least one filament yarn of the second type having a lower degree of elasticity than that of the at least one filament yarn of the first type; the at least one filament yarn of the second type, when a predetermined maximum rate of elongation of the hybrid elastic cable is reached, is fully elongated and the at least one filament yarn of the first type is wound in a helix around the at least one filament yarn of the second type, wherein the at least one filament yarn of the first type with said predetermined maximum rate of elongation is wound in a helix around the at least one filament yarn of the second type with a specific number of turns per linear meter of the hybrid elastic cable ranging between $n_{sE}$−15% and $n_{sE}$+15%, $n_{sE}$ being determined based on the following formula:

$$n_{sE} = \frac{1000}{\pi(\varphi_e + \varphi_K)} \times \frac{\sqrt{K_{max} \times (K_{max} + 200)}}{K_{max} + 100}$$

in which $n_{sE}$ is a number of turns per meter for the at least one filament yarn of the first type, $\phi_e$ is the diameter in mm of the at least one filament yarn of the first type at rest, $\phi_K$ is the diameter in mm of the at least one filament yarn of the second type, and $K_{max}$ is the predetermined maximum rate of elongation of the hybrid elastic cable, in a manner such that when the hybrid elastic cable is at rest, the at least one filament yarn of the second type is wound in a helix around the at least one filament yarn of the first type, without the separation of the at least one filament yarn of the second type from the at least one filament yarn of the first type or deformation of the hybrid elastic cable, said process comprising the following steps of:

stretching the at least one filament yarn of the first type, twisting the at least one filament yarn of the first type about itself with a specific number of turns about itself per linear meter of the hybrid elastic cable ranging between $n_{sE}$ and $3 \times n_{sE}$, the turns about itself of the of the filament yarn of the first type being wound in the opposite direction from the turns of the said helix.

11. The process for manufacturing the hybrid elastic cable according to claim 10, wherein a strand is obtained upon conclusion of the steps of winding and twisting, the process further comprising the step of integrally joining at least one drawing yarn along the strand, the drawing yarn having a low elasticity and being adapted to break under the effect of a predetermined load, the step of integrally joining being carried out after the steps of winding and twisting.

12. The process for manufacturing the hybrid elastic cable according to claim 11, wherein during the step of integrally joining, the rate of elongation of the section of the strand to which the drawing yarn is integrally joined is caused to be varied.

13. A manufactured object comprising at least one of a hybrid elastic cable comprising at least one filament yarn of a first type and at least one filament yarn of a second type, the at least one filament yarn of the first type having a lower degree of tenacity than that of the at least one filament yarn of the second type, and the at least one filament yarn of the second type having a lower degree of elasticity than that of the at least one filament yarn of the first type; the at least one filament yarn of the second type, when a predetermined maximum rate of elongation of the hybrid elastic cable is reached, is fully elongated and the at least one filament yarn of the first type is wound in a helix around the at least one filament yarn of the second type, wherein the at least one filament yarn of the first type with said predetermined maximum rate of elongation is wound in a helix around the at least one filament yarn of the second type with a specific number of turns per linear meter of the hybrid elastic cable ranging between $n_{sE}$−15% and $n_{sE}$+15%, $n_{sE}$ being determined based on the following formula:

$$n_{sE} = \frac{1000}{\pi(\varphi_e + \varphi_K)} \times \frac{\sqrt{K_{max} \times (K_{max} + 200)}}{K_{max} + 100}$$

in which $n_{sE}$ is a number of turns per meter for the at least one filament yarn of the first type, $\phi_e$ is the diameter in mm of the at least one filament yarn of the first type at rest, $\phi_K$ is the diameter in mm of the at least one filament yarn of the second type, and $K_{max}$ is the predetermined maximum rate of elongation of the hybrid elastic cable, the at least one filament yarn of the first type moreover being also twisted about itself with a specific number of distinct turns about itself per linear meter of the hybrid elastic cable ranging between $n_{sE}$ and $3 \times n_{sE}$ with the distinct turns about itself of the at least one filament yarn of the first type being wound in the opposite direction from that of the said helix, in a manner such that when the hybrid elastic cable is at rest, the at least one filament yarn of the second type is wound in a helix around the at least one filament yarn of the first type, without the separation of the at least one filament yarn of the second type from the at least one filament yarn of the first type or deformation of the hybrid elastic cable.

14. The manufactured object according to claim 13, the object comprising a sleeve woven using the hybrid elastic cable, the hybrid elastic cable including at least one drawing yarn integrally joined along the hybrid elastic cable, the said drawing yarn having a low elasticity and being adapted to break under the effect of a predetermined load, the sleeve comprising a plurality of warp yarns, the hybrid elastic cable forming the weft yarn, the hybrid elastic cable presenting at least first and second sections, the hybrid elastic cable having first intermediate rates of elongation along the first section when the drawing yarn is tensioned, the hybrid elastic cable having along the second section second intermediate rates of elongation lower than the first intermediate rates of elongation when the drawing yarn is tensioned, the first section of the hybrid elastic cable being an end section defining an end portion of the sleeve, the second section defining a central portion of the sleeve.

15. The manufactured object according to claim 14, wherein the hybrid elastic cable has third intermediate rates of elongation along a second end section when the drawing yarn is tensioned, the second intermediate rates of elongation being lower than the third intermediate rates of elongation, said second end section defining a second end of the sleeve.

16. The manufactured object according to claim 14, comprising an inflatable bladder, the sleeve being fitted around the inflatable bladder.

* * * * *